United States Patent [19]

Ricciardelli

[11] 4,252,183

[45] Feb. 24, 1981

[54] SNOW AND ICE REMOVAL APPARATUS

[76] Inventor: Libero Ricciardelli, 251 Garden St., Cambridge, Mass. 02138

[21] Appl. No.: 40,069

[22] Filed: May 17, 1979

[51] Int. Cl.[3] ..... E04B 13/00

[52] U.S. Cl. ..... 165/47; 126/417

[58] Field of Search ..... 52/11, DIG. 16, 199, 52/536; 165/48 S, 47; 126/417

[56] References Cited

U.S. PATENT DOCUMENTS

| | | | |
|---|---|---|---|
| 166,890 | 8/1875 | Querner | 52/199 |
| 2,129,833 | 9/1938 | Fradette | 52/24 |
| 3,006,113 | 10/1961 | Barnes | 52/DIG. 16 |
| 3,366,168 | 1/1968 | Dale | 165/47 |
| 3,388,738 | 6/1968 | Dery | 52/DIG. 16 |

FOREIGN PATENT DOCUMENTS

| | | | |
|---|---|---|---|
| 1161974 | 9/1958 | France | 52/536 |

*Primary Examiner*—Price C. Faw, Jr.
*Assistant Examiner*—Henry E. Raduazo

[57] ABSTRACT

A device for ridding roofs of snow and ice comprising a rigid, elongate channel member of half-circular right section having at its open side spaced, parallel edges, flanges along said edges and tabs at the ends of the channel member for securing the open side downwardly on the surface of the roof at right angles to the ridge line of the roof with the lower end overlapping the fascia and gutter, if any. Several such channel members are secured to the roof at longitudinally-spaced intervals.

1 Claim, 4 Drawing Figures

SNOW AND ICE REMOVAL APPARATUS

BACKGROUND OF THE INVENTION

This invention relates to an energy-conserving device for ridding roofs of snow and ice which requires neither a commercial energy source nor attention after installation, which is simple to install and which has an indefinite effective life.

The ice-dam problem on roofs results from snow which alternatively thaws and freezes forming along the entire length of the eaves a barrier of ice behind which water melting from the upper warmer roof areas accumulates and, seeking its own level, backs up under the roof shingles and runs down through the roof boards into the attic and finally through the ceilings and down into the interior walls, causing immense damage to both the building and its contents and furnishings.

Various expedients have been employed to eliminate this condition, one of which is the electric de-icing cable commonly marketed and installed throughout the northern regions of this country both in 10 foot sections comprising 25 linear feet of cable consuming 125 watts of electrical energy and in 32 foot sections comprising 80 linear feet of cable consuming 560 watts of electricity. An average ranch-style house 50 feet long requires four (4) 32 foot sections consuming 2240 watts of electricity, plus another 100 feet for the two at least gutters and 50 feet for the four at least conductor pipes for a total consumption of about 3000 watts of electricity. Such installations require grounds hammered into the ground, clips and separator links to help minimize short-circuiting and potential house fires all weather connections between all sections and all weather plugs and receptacles installed on the exterior side walls with indoor wiring and lighting switches. Thus, the whole installation is complex, expensive and represents a colossal expenditure of energy from increasingly scarce fuel stocks.

Non-energy causing devices other than de-icing cables have been patented as shown, for example, in Creighton U.S. Pat. No. 189,431, Apr. 10, 1877, which utilizes solar heat within the gutter area, but does not prevent ice build-up on the surface of the roof above the gutter area. Hess U.S. Pat. No. 233,677, Oct. 26, 1880, utilizes a box and cover to prevent the upper open end of the conductor pipe from becoming clogged or frozen or becoming choked up with sticks, gravels or other refuse. The structure is not effective to prevent the problem of ice dam. Farren, U.S. Pat. No. 2,624,298 utilizes hollow tiles designed to produce air passages below the roof surface. None of the foregoing patents disclose means for effectively ridding a roof of ice damming.

The primary purpose of this invention is to eliminate water damage and destruction of buildings caused by leakage due to the formation of ice dams on the eaves of roofs by harnessing directly and effectively various sources of natural energy without contributing to environmental pollution, and thus to effectively conserve commercial forms of energy currently being consumed in enormous quantities. This is achieved herein by means of a device designed to be fastened to the roof without alteration of the latter, which will absorb heat from the direct rays of the sun, capture roof heat loss radiation and side wall heat loss radiation resulting from thermal convection and effectively channel the same along the surface of the roof from the eaves upwardly and, in addition, channel the water resulting from melting of the snow and ice downwardly on the surface of the roof.

The invention will now be described in greater detail with reference to the accompanying drawings, wherein.

Figure 1:
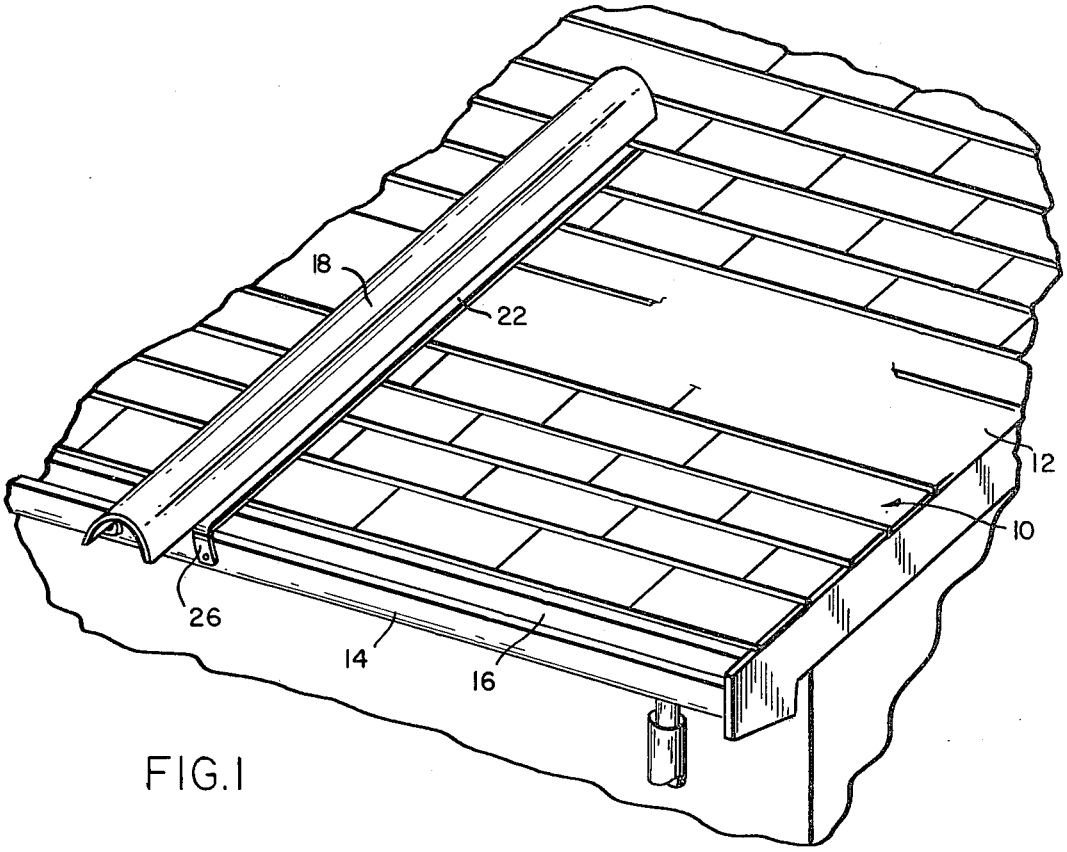
FIG. 1 is a fragmentary perspective view of an inclined shingled roof showing one of the devices of this invention installed thereon.
Figure 2:
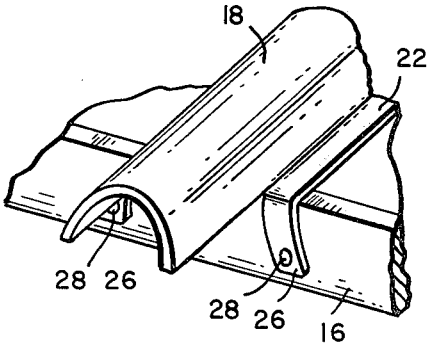
FIG. 2 is a fragmentary perspective of the lower end of one of the devices showing the tabs for fastening the lower end to the fascia board.
Figure 3:
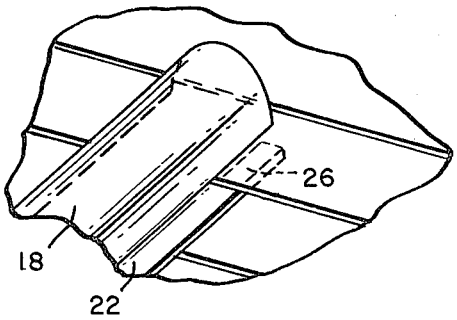
FIG. 3 is a fragmentary perspective of the upper end of one of the devices showing the tabs for securing it beneath the shingles on the roof.
Figure 4:
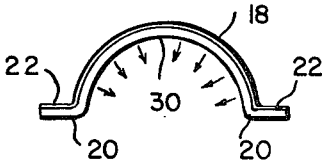
FIG. 4 is a transverse section through the device showing a heat absorbent surface on the outer side and a reflective surface on the inner side.

Referring to the drawings, FIG. 1 shows a conventional inclined roof 10 surfaced with shingles 12 and provided along its lower edge a gutter 14 and fascia board 16.

The devices of this invention are fastened to the roof at longitudinally-spaced intervals in parallel relation to each other and at right angles to the fascia and comprise elongate channel members of half-circular right section having at the open side spaced, parallel straight edges 20—20 and along the edges 20—20 flanges 22—22. The ends of the device are open.

The flanges 22—22 at the open ends are severed along their junctions with the channel member providing at opposite ends and at opposite sides bendable tabs 26—26. The lower tabs are provided with perforations 28 for receiving fastening means such as nails at the fascia or gutter only.

The device is mounted on the roof with its concave side facing downwardly by inserting the tabs at the upper end beneath the course of shingles at the upper end and by bending the tabs at the lower end downwardly against the fascia board or the gutter and securing them with nails. The tabs at the upper end are inserted under the shingles and may be secured with roofing cement, if desired.

The outer convex surface of the device is made absorbitive of heat, for example, by an application of black paint 18 and the inner concave surfaces made reflective by providing a metallic reflective surface 30. Desirably, the device is comprised of corrosion-resistant, heat-transmitting metal such as duralumin or other appropriate material.

As related above, several such devices are placed at longitudinally-spaced intervals on the roof and each defines a heat accumulator which channels heat upwardly along the surface of the roof and channels water resulting from the melting of snow and ice downwardly along the surface of the roof. As a heat accumulator, the device absorbs the heat rays of the sun and transmits them to the interior, reflects the heat escaping through the surface of the roof and conducts side wall heat loss at the lower end upwardly along the roof. The devices are preferably spaced no more than five feet from the ends of the roof, no more than three feet from a valley and no more than ten feet apart from one another.

The devices as thus described are extremely inexpensive to manufacture and install, require no upkeep, and make use of solar heat and natural heat losses.

It should be understood that the present disclosure is for the purpose of illustration only and includes all modifications or improvements which fall within the scope of the appended claims.

I claim:

1. A device for ridding roofs of accumulations of snow and ice comprising an elongate channel member of half-circular right section, said channel member having unobstructed open ends, diametrically-positioned flanges at opposite longitudinal edges of the channel member defining flat planar surfaces for supporting the channel member concave-side down on the roof, said flanges being integral with the edges of the channel throughout the major portion of the length of the channel and the said flanges at the opposite ends of the channel member being severed from the edges at their junctions therewith so as to provide tabs at the ends bendable relative to the planar surfaces of the flanges at the upper ends to enable bending them downwardly relative to the channel member to dispose them beneath a course of shingles at the upper end and at the lower end to enable folding them downwardly against the fascia board at the edge of the roof and said latter tabs containing holes for receiving fastening elements, said channel and flanges being comprised of Duralumin and provided with a coating of black paint on the outer side and a reflective surface on the inner side.

* * * * *